US006045460A

United States Patent [19]

Hayashi et al.

[11] Patent Number: 6,045,460

[45] Date of Patent: Apr. 4, 2000

[54] MULTI-PIECE SOLID GOLF BALL

[75] Inventors: Junji Hayashi; Hisashi Yamagishi; Hiroshi Higuchi, all of Chichibu, Japan

[73] Assignee: Bridgestone Sports Co., Ltd., Tokyo, Japan

[21] Appl. No.: 09/086,383

[22] Filed: May 29, 1998

Related U.S. Application Data

[60] Provisional application No. 60/049,605, Jun. 13, 1997.

[30] Foreign Application Priority Data

May 29, 1997 [JP] Japan ..... 9-155812

[51] Int. Cl.[7] ..... A63B 37/12

[52] U.S. Cl. ..... 473/376

[58] Field of Search ..... 473/376

[56] References Cited

U.S. PATENT DOCUMENTS 5,816,937 10/1998 Shimosaka et al. ..... 473/376 X

*Primary Examiner*—Steven Wong

*Attorney, Agent, or Firm*—Sughrue, Mion, Zinn, Macpeak & Seas, PLLC

[57] ABSTRACT

An object is to provide a multi-piece solid golf ball comprising an inner sphere, an enclosure layer, an inner cover, and an outer cover wherein the respective layers are optimized as well as the weight and inertia moment of the ball so that the ball may have improved flight performance, hitting feel, controllability, and especially straight-path rolling on the green without the influence of subtle angulations and can exert its superior performance at any situation encountered in the round.

A multi-piece solid golf ball comprising a core including an inner sphere and at least one enclosure layer surrounding the inner sphere and a cover consisting of an inner cover surrounding the core and an outer cover surrounding the inner cover is characterized in that the inner sphere has a hardness expressed by a distortion of 1.5–4.5 mm under a load of 100 kg, the surface hardness of the enclosure layer is lower than the surface hardness of the inner sphere in Shore D, the inner cover has a Shore D hardness of at least 55, the outer cover has a Shore D hardness of 35–53, and the ball has a weight of 44.5–45.93 grams and an inertia moment of at least (1.52×ball weight (gram)+12.79) g·cm$^2$.

12 Claims, 1 Drawing Sheet

MULTI-PIECE SOLID GOLF BALL

CROSS REFERENCE TO RELATED APPLICATION

This application is an application filed under 35 U.S.C. § 111(a) claiming benefit pursuant to 35 U.S.C. § 119(e)(i) of the filing date of the Provisional Application 60/049,605 filed on Jun. 13, 1997 pursuant to 35 U.S.C. § 111(b).

BACKGROUND OF THE INVENTION

1. Field of the Invention

This invention relates to a multi-piece solid golf ball of a structure having at least four layers, and more particularly, to such a multi-piece solid golf ball which is improved in flight performance, hitting feel, and controllability, and rolls straight on the green.

2. Prior Art

Golf balls of various structures are currently on the market. Among others, two-piece solid golf balls having a rubber based solid core encased in a cover typically of ionomer resin and thread-wound golf balls produced by winding thread rubber around a solid or liquid center and enclosing the center with a cover are commonly used in competitions.

The two-piece solid golf balls are used by many ordinary golfers because of superior flying performance and durability although they have the drawbacks including a very hard feel upon hitting and less controllability because of quick separation from the club face upon impact.

To improve the hard hitting feel of solid golf balls, various two-piece solid golf balls of soft type were proposed. In general, many soft type two-piece solid golf balls use soft cores. Softening the core invites not only a lowering of restitution which leads to poor flight performance, but also a substantial loss of durability. Then the flight performance and durability characteristic of two-piece solid golf balls are not maintained, sometimes giving rise to the problem that the golf balls are practically unacceptable.

Therefore, there is a desire to have a solid golf ball which can be improved in feel and controllability at no sacrifice of flight distance and durability. One of such proposals is a three-piece solid golf ball of three layer structure having an intermediate layer interposed between the inner sphere and the cover.

Such three-piece solid golf balls proposed heretofore include, for example, (1) a three-piece solid golf ball comprising a solid core consisting of a relatively soft, small diameter inner sphere and a harder intermediate layer surrounding the inner sphere wherein the percent area of contact with the club face upon hitting is specified (Japanese Patent Publication (JP-B) No. 55077/1992, Japanese Patent Application Kokai (JP-A) No. 80377/1989, etc.);

(2) a three-piece solid golf ball comprising a solid core (or inner sphere), an inner cover surrounding the core as an intermediate layer, and an outer cover formed on the surface of the inner cover wherein the diameter and specific gravity of the solid core, the gage, specific gravity and JIS-C hardness of the inner cover, and the gage of the outer cover are specified, especially the JIS-C hardness of the inner cover is specified relatively high (JP-A 24084/1995 etc.); and (3) a three-piece solid golf ball wherein the diameter and specific gravity of the solid core, the gage, specific gravity and JIS-C hardness of the intermediate layer (or inner cover), and the gage of the outer cover are specified, especially the JIS-C hardness of the intermediate layer is specified relatively high (JP-A 24085/1995).

However, the proposal relating to the three-piece solid golf ball (1), in which the hardness of the cover is not definitely specified, would provide insufficient restitution if a golf ball having a relatively soft or low hardness cover is formed. If a golf ball having a relatively hard or high hardness cover is formed, the hitting feel upon approach shots causing smaller deformation becomes hard because the intermediate layer encased in the cover is harder than the solid core.

Also, the three-piece solid golf ball (2) offers a soft hitting feel, but is difficult to control because of the hard outer cover.

Further, the three-piece solid golf ball (3), in which the core that mostly affects feel and restitution is made relatively soft, provides insufficient restitution and fails to travel a long distance as long as the hitting feel is fully soft. Inversely, in the core hardness range ensuring sufficient restitution, the hitting feel is hard because the intermediate layer is also hard, and low-head speed players cannot provide the ball with sufficient deformation to fly a long distance.

Meanwhile, with respect to the above-mentioned problems of solid golf balls, it was recently proposed to achieve an improvement by increasing an inertia moment. For example, JP-B 48473/1992 proposes a solid golf ball whose inertia moment is controlled by adding fillers to the cover stock and the core stock, for thereby increasing the flight distance without deteriorating the durability and appearance of the cover surface.

However, this proposal, in which the hardness of the core is not definitely specified, suffers from the problem that the use of a hard core results in a hard hitting feel whereas the use of a soft core softens the hitting feel at the sacrifice of restitution and flight performance. The ball is less easy to control because of the hard outer cover.

SUMMARY OF THE INVENTION

An object of the present invention which has been made under the above-mentioned circumstances is to provide a multi-piece solid golf ball in which an inner sphere, an enclosure layer, an inner cover, an outer cover, a ball weight and an inertia moment are optimized so that the ball may have improved flight performance, hitting feel, controllability, and straight-path rolling on the green.

Making extensive investigations in order to attain the above object, we have found that when a multi-piece solid golf ball comprising a multiple solid core including an inner sphere and at least one enclosure layer surrounding the inner sphere and a cover consisting of an inner cover surrounding the core and an outer cover surrounding the inner cover is formed such that the inner sphere has a hardness expressed by a distortion or deflection of 1.5 to 4.5 mm under a load of 100 kg. The surface hardness of the enclosure layer is lower than the surface hardness of the inner sphere in Shore D, the inner cover has a Shore D hardness of at least 55, the outer cover has a Shore D hardness of 35 to 53, and the ball has a weight of 44.5 to 45.93 grams and an inertia moment of at least (1.52×ball weight (gram) +12.79) $g \cdot cm^2$. The respective layers and the overall weight and inertia moment of the golf ball are optimized so that high restitution, a greater inertia moment, improved spin and improved flight performance are ensured and a pleasant hitting feel inclusive of softness and click is obtained upon shots with a driver or long iron. An increased spin rate, a short run, and a pleasant hitting feel are obtained upon approach shots with a sand wedge or short iron. Also a straight rolling path is followed on the green upon putting without the influence of subtle angulations on the green. The inventors have additionally found that these superior characteristics are more outstandingly exerted when the inner sphere is formed of a rubber base material and has a diameter of 20 to 37 mm, and the core has a diameter of 32 to 41 mm; when the inner cover has a gage of 0.5 to 3 mm, the outer cover has a gage of 0.3 to 3 mm, and the difference in Shore D hardness between the inner cover and the outer cover is at least 5; when at least one layer of the outer cover, the inner cover and the enclosure layer has a high specific gravity inorganic filler blended therein; and when the outer cover is formed of a thermoplastic polyurethane elastomer. The present invention is predicated on these findings.

Accordingly, the present invention provides:

(1) a multi-piece solid golf ball comprising a core including an inner sphere and at least one enclosure layer surrounding the inner sphere and a cover consisting of an inner cover surrounding the core and an outer cover surrounding the inner cover, characterized in that said inner sphere has a hardness expressed by a distortion of 1.5 to 4.5 mm under a load of 100 kg, said enclosure layer has a surface hardness lower than the surface hardness of the inner sphere in Shore D, said inner cover has a Shore D hardness of at least 55, said outer cover has a Shore D hardness of 35 to 53, and said ball has a weight of 44.5 to 45.93 grams and an inertia moment of at least (1.52 ×ball weight (gram)+12.79) $g \cdot cm^2$;

(2) a multi-piece solid golf ball according to (1) wherein said inner sphere is formed of a rubber base material and has a diameter of 20 to 37 mm, and said core has a diameter of 32 to 41 mm;

(3) a multi-piece solid golf ball according to (1) or (2) wherein the inner cover has a gage of 0.5 to 3 mm, the outer cover has a gage of 0.3 to 3 mm, and the difference in Shore D hardness between the inner cover and the outer cover is at least 5;

(4) a multi-piece solid golf ball according to any one of (1) to (3) wherein at least one layer of the outer cover, the inner cover and the enclosure layer has a high specific gravity inorganic filler blended therein; and (5) a multi-piece solid golf ball according to any one of (1) to (4) wherein the outer cover is formed of a thermoplastic polyurethane elastomer.

DETAILED DESCRIPTION OF THE INVENTION

Figure 1:
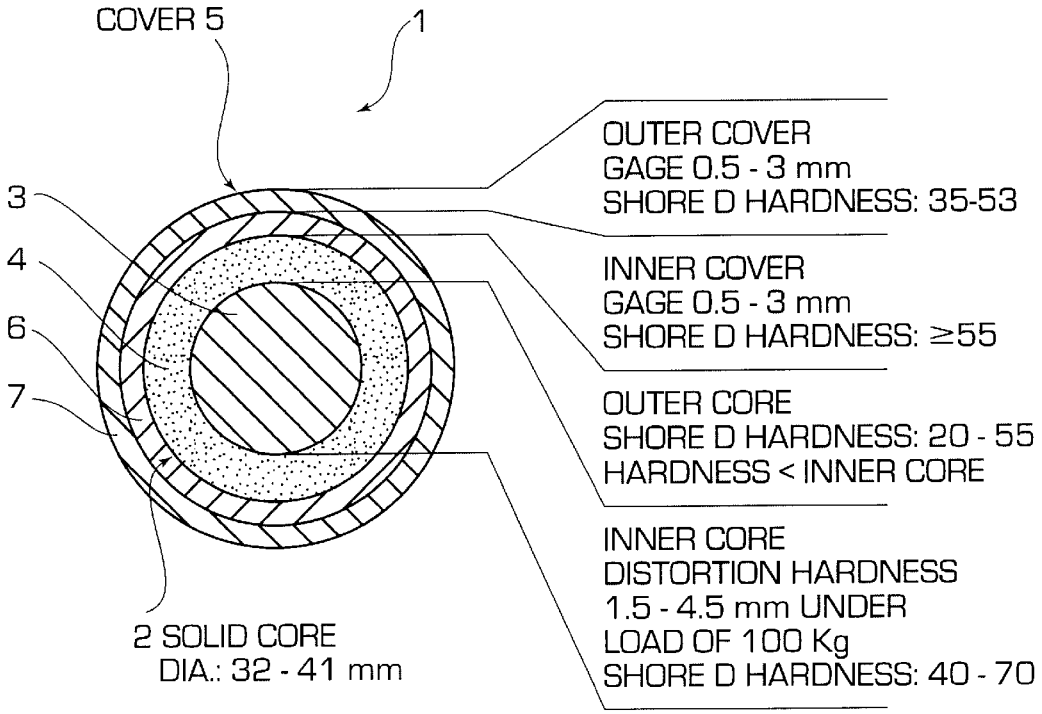
FIG. 1 is a schematic cross section of one exemplary multi-piece solid golf ball according to the invention.

The invention is described below in detail. Referring to FIG. 1, a multi-piece solid golf ball 1 according to the invention is illustrated as comprising a solid core 2 consisting of an inner sphere 3 and an enclosure layer 4 surrounding the inner sphere and a cover 5 consisting of inner and outer covers 6 and 7. According to the invention, the hardness of the inner sphere, the difference in Shore D surface hardness between the inner sphere and the enclosure layer, the Shore D hardness of the inner and outer covers, and the weight and inertia moment of the ball are optimized as mentioned above. It is noted that the enclosure layer 4 may consist of either a single layer (in this case, the golf ball becomes of four layer structure) or a plurality of layers and is not limited in this regard.

The inner sphere 3 constituting the solid core 2 should have a hardness expressed by a distortion or deflection of 1.5 to 4.5 mm, preferably 1.8 to 4.2 mm under a load of 100 kg. A too greater distortion under an applied load of 100 kg tends to lower restitution, reduce a flight distance and lose click. A core with a too less distortion is too hard and adversely affects the hitting feel. Also the inner sphere 3 has an appropriate surface hardness which is higher than the hardness of the enclosure layer to be described later and in many cases, preferably ranges from 40 to 70, especially from 42 to 65 in Shore D.

Also the specific gravity of the inner sphere 3 is not critical although it is usually adjusted to 1.0 to 1.7, especially 1.05 to 1.5.

In the practice of the invention, the inner sphere 3 may be formed from well-known materials by a well-known method like the core of prior art two-piece solid golf balls. Exemplary components which can be used herein are a rubber base, crosslinking agent, co-crosslinking agent, inert filler, etc.

As the rubber base, natural rubber and/or synthetic rubber may be advantageously used, and especially 1,4-polybutadiene containing at least 40% of cis-structure is advantageously used. If desired, natural rubber, polyisoprene rubber, styrene-butadiene rubber or the like is blended in the polybutadiene.

The crosslinking agent is exemplified by organic peroxides such as dicumyl peroxide and di-tert-butyl peroxide, with the dicumyl peroxide being especially preferred. The amount of the crosslinking agent blended is generally about 0.5 to 2.0 parts by weight per 100 parts by weight of the rubber base.

The co-crosslinking agent is exemplified by metal salts of unsaturated fatty acids, inter alia, zinc and magnesium salts of unsaturated fatty acids having 3 to 8 carbon atoms (e.g., acrylic acid and methacrylic acid), with the zinc acrylate being especially preferred. The amount of the co-crosslinking agent blended may be properly adjusted in the range of 5 to 50 parts by weight per 100 parts by weight of the rubber base.

Examples of the inert filler include zinc oxide, barium sulfate, silica, calcium carbonate, and zinc carbonate, with zinc oxide and barium sulfate being typical. The amount of the filler blended varies with the specific gravity of the solid core and cover, the weight standard of the ball and other factors and is not particularly limited although the filler amount is usually 5 to 100 parts by weight per 100 parts by weight of the rubber base. In the practice of the invention, the amounts of the crosslinking agent, co-crosslinking agent and inert filler can be properly selected so as to provide the inner sphere with an optimum weight and an optimum distortion under an applied load of 100 kg.

From the inner sphere-forming composition obtained by blending the above-mentioned components, an inner sphere may be prepared by kneading the composition in a conventional kneader such as a Banbury mixer or roll mill, for example, compression or injection molding the composition in an inner sphere mold, and heat curing the molded part at a sufficient temperature for the crosslinking and co-crosslinking agents to act (for example, about 130 to 170° C. when dicumyl peroxide and zinc acrylate are used as the crosslinking and co-crosslinking agents, respectively).

The diameter of the thus obtained inner sphere is properly adjusted in accordance with the gage of the enclosure layer, inner cover and outer cover to be described later although the inner sphere is preferably formed to a diameter of 20 to 37 mm, especially 22 to 35 mm.

The enclosure layer 4 surrounding the inner sphere 3 is formed to a surface hardness lower than the surface hardness of the inner sphere in Shore D. By encasing a relatively hard inner sphere 3 in a relatively soft enclosure layer 4, a soft hitting feel with click is obtained while maintaining restitution. In this case, the enclosure layer should preferably have a surface hardness of 20 to 55, more preferably 25 to 50 in Shore D, which is preferably lower than the surface hardness of the inner sphere by 5 to 50, especially by 7 to 40.

The enclosure layer 4 may be formed of either a rubber base material like the above-mentioned inner sphere 3 or thermoplastic resins such as polyester elastomers and ionomer resins. The thermoplastic polyester elastomers which can be used herein are exemplified by commercially available products such as Hytrel 4001 and 3078 (Toray-duPont K.K.). They may be used alone or in admixture of two or more.

In the practice of the invention, when the enclosure layer is formed, its specific gravity may be adjusted by blending a high specific gravity inorganic filler in the material. The specific gravity of the enclosure layer, which varies with the specific gravity of the base component, the inner sphere and the cover, can usually be adjusted to 1.0 to 1.7, especially 1.0 to 1.5. Examples of the high specific gravity inorganic filler which can be used herein include tungsten, zinc oxide, and barium sulfate.

Where the high specific gravity inorganic filler is not blended, the specific gravity of the enclosure layer, which varies with the specific gravity of the base component, the inner sphere and the cover, in many cases, preferably falls in the range of 0.9 to 1.3, especially 0.9 to 1.2.

The solid core 2 is obtained using the enclosure layer 4, for example, by a method of placing the inner sphere 3 in a mold, and then enclosing the inner sphere 3 with the above-mentioned material by compression or injection molding selected depending on whether the material is the rubber composition or resin material. Where the enclosure layer 4 consists of two or more layers, the solid core can be formed by a similar method.

In the practice of the invention, the solid core 2 consisting of the inner sphere 3 and the enclosure layer 4 is not particularly limited insofar as its surface hardness falls in the above-defined range of Shore D hardness. The core may be formed to a diameter of 32 to 41 mm, especially 34 to 40 mm.

The multi-piece solid golf ball of the invention is constructed by encasing the above-mentioned solid core 2 consisting of the inner sphere 3 and the enclosure layer 4 in the cover 5 while the cover 5 consists of the inner cover 6 surrounding the surface of the solid core 2 and the outer cover 7 surrounding the surface of the inner cover 6.

The inner cover 6 has a higher Shore D hardness than the outer cover 7. More specifically, the inner cover 6 has a Shore D hardness of at least 55, especially 55 to 70, while the outer cover 7 has a Shore D hardness of 35 to 53, especially 40 to 53. The hardness difference between them is desirably at least 5, more preferably 5 to 25.

With the outer cover made softer in this manner, the spin performance upon approach shots is improved and the hitting feel upon approach shots and putting becomes soft. The use of a hard resilient resin as the inner cover maintains the flight performance satisfactory.

Preferably the inner cover 6 has a gage (radial thickness) of 0.5 to 3 mm, especially 0.7 to 2.8 mm and the outer cover 7 has a gage of 0.3 to 3 mm, especially 0.5 to 2.5 mm. An inner cover that is to thick would exacerbate feeling whereas an inner cover that is to thin would reduce the restitution of the ball, failing to achieve satisfactory flight performance. An outer cover that is to thin would render the ball less durable whereas one that is too thick would reduce restitution.

The materials of which the inner and outer covers 6 and 7 are constructed are not critical. Well-known cover stocks may be used. Using thermoplastic resins including ionomer resins and non-ionomer resins, the covers can be formed to the above-defined hardnesses. More particularly, exemplary inner cover stocks are commercially available products including ionomer resins such as Himilan 1605, 1706, AM7317 and AM7318 (Mitsui-duPont Polychemical K.K.) and thermoplastic polyester elastomers such as Hytrel 5557 (Toray-duPont K.K.). They may be used alone or in admixture of two or more.

Exemplary outer cover stocks include thermoplastic polyurethane elastomers, ionomer resins, polyester elastomers, and polyamide elastomers, alone or in admixture of two or more. Examples are commercially available products including ionomer resins such as Himilan 1706 (Mitsui-duPont Polychemical K.K.) and Surlyn 8120 (E. I. duPont) and thermoplastic polyurethane elastomers such as Pandex T7890 and T7298 (Dai-Nihon Ink Chemical Industry K.K.). The invention favors to use the thermoplastic polyurethane elastomers as a base.

In the stocks of the inner and outer covers 6 and 7, a high specific gravity inorganic filler may be blended in order to adjust their specific gravity. The filler which can be blended herein may be any of those exemplified for the enclosure layer whereby the specific gravity of the cover stock can be generally adjusted to 1.0 to 1.5 although it varies with the specific gravity of the base resin and the core. Where the high specific gravity inorganic filler is not blended, the specific gravity of the cover stock, which depends on the type of resin used, can be 0.9 to 1.2.

The multi-piece solid golf ball of the invention is formed to a ball weight of 44.5 to 45.93 grams and an moment of inertia (MI) of at least the value given by the following equation (1).

$$MI(\text{g}\cdot\text{cm}^2)=1.52\times\text{ball weight (gram)}+12.79 \quad (1)$$

According to our investigation, the moment of inertia has an optimum range correlated to a cover hardness. That is, the moment of inertia must be greater as the cover becomes harder and need not be so great as required for hard covers when the cover is soft. This is because a soft cover causes a greater frictional force and hence, more spin upon impact whereas a hard cover causes a less frictional force and hence, less spin upon impact. When a hard cover ball is launched with a low spin rate, the spin will soon attenuate if the moment of inertia is small, and the ball will thus stall in the falling orbit. Inversely, when a soft cover ball is launched with a high spin rate, the spin attenuation is slow if the moment of inertia is too large, and the ball will thus loft higher during flight due to the more than necessity spin. In either case, the ball tends to reduce the flight distance.

Since the cover 5 of the golf ball according to the invention consists of a hard inner cover and a soft outer cover, which means that the moment of inertia specified for the above-mentioned single layer cover which is either high or low in hardness is not directly applicable to the inventive golf ball. Additionally, since the cover is formed around the solid core consisting of a hard inner sphere and a soft enclosure layer, the moment of inertia of the golf ball according to the invention is optimized to the above-defined range so as to be appropriate for such a hard/soft structure. If the moment of inertia is lower than the above-specified value, the ball cannot fully sustain spin or follow a long-lasting trajectory, resulting in a shorter carry.

By increasing the moment of inertia in this way, the rolling of the ball on the green upon putting is improved so that the ball may roll straight on the green without being affected by subtle angulations on the green.

It is noted that the moment of inertia is a value calculated from the diameter (or thickness) and specific gravity of the respective layers and can be determined from the following equation (2) provided that the ball is spherical in shape. Although the ball is assumed to be spherical for the calculation purpose, the specific gravity of the outer cover layer is lower than the actual specific gravity of the outer cover resin because of the presence of dimples. The specific gravity of the outer cover is designated herein the phantom specific gravity of the outer cover and the moment of inertia is calculated using the same.

$$MI=Ax\{(a-b)xm^5+(b-c)xn^5+(c-d)xp^5+dxq^5\} \quad (2)$$

MI: moment of inertia ($g\cdot cm^2$)

A: constant, $\pi/5880000$ a: inner sphere specific gravity b: enclosure layer specific gravity c: inner cover specific gravity d: outer cover phantom specific gravity m: inner sphere diameter n: core diameter p: diameter of a sphere obtained after encasing the core in the inner cover q: ball diameter Note that the diameter of each layer is expressed in mm.

Accordingly, the specific gravity and diameter of the inner sphere, enclosure layer, inner cover and outer cover are properly selected such that the moment of inertia determined from equation (2) may be equal to or higher than the value of moment of inertia calculated from the ball weight according to equation (1).

Although the above-mentioned equation (2) applies to the enclosure layer consisting of a single layer, the moment of inertia can be calculated according to a similar equation when the enclosure layer consists of a plurality of layers.

There has been described a golf ball wherein the inner sphere 3, enclosure layer 4, inner cover 6, and outer cover 7 and the weight and inertia moment of the golf ball having such layers successively encased are optimized. Upon shots with a driver or long iron, the golf ball of the invention provides good restitution, a spin rate appropriately suppressed so as to prohibit lofting, good spin sustainment, and a long-lasting trajectory, succeeding in increasing the carry. Upon shots with a short iron or pitching wedge, the golf ball of the invention stops well due to the spin characteristics and offers a well controllable flight track with a reduced run, allowing the player to aim the pin dead. Upon putting on the green, the superior rolling of the golf ball ensures that the ball rolls straight on the green without being substantially affected by subtle angulations. Upon any shot and putting, the golf ball of the invention offers a pleasant hitting feel inclusive of softness and appropriate click and can exert its superior performance at any situation encountered in the round.

Like conventional golf balls, the golf ball of the invention is formed with a multiplicity of dimples in its surface. The number of dimples is not particularly limited although usually 300 to 550 dimples, especially 330 to 500 dimples are usually formed. There may be dimples of two or more types which are different in diameter, depth or the like. The arrangement of dimples is not particularly limited and may be any of well-known arrangements including regular octahedral, dodecahedral, and icosahedral arrangements. The pattern which is depicted on the ball surface by such dimple arrangements may be any one of square, hexagon, pentagon, and triangle patterns.

The parameters of the golf ball of the invention may be properly determined in accordance with the Rules of Golf without deviating from the above-defined scope of the invention.

The multi-piece solid golf ball of the invention in which the inner sphere, enclosure layer, inner cover, and outer cover and the weight and inertia moment of the ball are optimized is improved in flight performance, hitting feel, and controllability, especially exhibits straight-path rolling on the green without the influence of subtle angulations, and can exert its superior performance at any situation encountered in the round.

EXAMPLE

Examples of the present invention are given below together with Comparative Examples by way of illustration. The invention is not limited to the following Examples.

Examples and Comparative Examples

Solid golf balls with parameters as shown in Table 2 were prepared by a conventional method using rubber compositions and thermoplastic resin compositions of the formulation shown in Table 1 (wherein all units are parts by weight). The outer cover of the golf ball was formed in its surface with 420 dimples in a regular icosahedral arrangement.

Note that the golf balls of Comparative Examples 1 to 4 were prepared according to the following patent publications and had the following characteristics.

Comparative Example 1 was a three-piece solid golf ball formed according to JP-A 24085/1995 wherein the core (consisting solely of an inner sphere) had a relatively high Shore D hardness (Shore D hardness 50) and was free of an enclosure layer.

Comparative Example 2 was a three-piece solid golf ball formed according to JP-A 24085/1995 wherein the core (consisting solely of an inner sphere) had a relatively low Shore D hardness (Shore D hardness 42) and was free of an enclosure layer.

Comparative Example 3 was a three-piece solid golf ball formed according to JP-B 48473/1992 wherein the inner cover had a relatively high specific gravity and the inertia moment was large.

Comparative Example 4 was a general two-piece solid golf ball wherein the core was relatively hard (Shore D hardness 54) and encased in an outer cover having a lower Shore D hardness than the core.

The thus obtained golf balls were examined for inertia moment, flight performance, spin, hitting feel and rolling by the following tests. The results are also shown in Table 2.

Moment of Inertia

The diameter and thickness of the respective elements each were an average of five measurements. As to the weight, the inner sphere, the core, the core encased in the inner cover, and the ball were measured for weight midway the ball manufacturing process. From these measurements, the addition weight and volume were calculated and the specific gravity calculated therefrom. With respect to the outer cover, its phantom specific gravity was used as mentioned above. The moment of inertia was calculated by substituting these values in equation (2).

$$MI=Ax\{(a-b)xm^5+(b-c)xn^5+(c-d)xp^5+dxq^5\} \quad (2)$$

MI: moment of inertia ($g\cdot cm^2$)

A: constant, $\pi/5880000$ a: inner sphere specific gravity b: enclosure layer specific gravity c: inner cover specific gravity d: outer cover phantom specific gravity m: inner sphere diameter n: core diameter p: diameter of a sphere obtained after encasing the core in the inner cover q: ball diameter Note that the diameter of each layer is expressed in mm.

Flight Performance

Using a swing robot manufactured by True Temper Co., the ball was hit with a driver (PRO 230 Titan, loft angle 10°, manufactured by Bridgestone Sports Co., #W1) at a head speed of 50 m/sec. (HS50) and 35 m/sec. (HS35) to measure a spin rate, carry and total distance.

Spin Rate

Using the same swing robot as above, the ball was hit with a sand wedge (J's Classical Edition, manufactured by Bridgestone Sports Co., #Sw) at a head speed(HS25) m/sec. (HS25) to measure a spin rate and run (total distance minus carry).

Hitting Feel

Five professional golfers with a head speed of about 50 m/sec. actually hit the ball with a driver (#w1), a sand wedge (#SW), and a putter (#PT) to examine the ball for hitting feel according to the following criteria.

#w1

○: soft feel with click

Δ: soft, but weak feel without click

X: hard feel

#SW

○: soft feel

Δ: ordinary

X: hard feel

#PT

○: soft feel

Δ: ordinary

X: hard feel

Rolling

In the putting test for examining the hitting feel, the ball was examined for rolling according to the following criterion.

○: straight and long-lasting rolling

X: not straight and not long-lasting

TABLE 1

| | | Example | | | | | | Comparative Example | | | |
|---|---|---|---|---|---|---|---|---|---|---|---|
| | | 1 | 2 | 3 | 4 | 5 | 6 | 1 | 2 | 3 | 4 |
| Inner sphere | Cis-1,4-polybutadiene | 100 | 100 | 100 | 100 | 100 | 100 | 100 | 100 | 100 | 100 |
| | Zinc acrylate | 33.6 | 37.2 | 25.4 | 33.6 | 25.4 | 33.6 | 31.1 | 21.2 | 30.3 | 33.6 |
| | Dicumyl peroxide | 1.2 | 1.2 | 1.2 | 1.2 | 1.2 | 1.2 | 1.2 | 1.2 | 1.2 | 1.2 |
| | Antioxidant | 0.2 | 0.2 | 0.2 | 0.2 | 0.2 | 0.2 | 0.2 | 0.2 | 0.2 | 0.2 |
| | Zinc oxide | 5 | 5 | 5 | 5 | 5 | 5 | 5 | 5 | 5 | 5 |
| | Barium sulfate | 17.2 | 15.7 | 21.6 | 12.2 | 22.5 | 18.9 | 37.4 | 41.0 | 14.1 | 23.3 |
| Enclosure layer | Cis-1,4-polybutadiene | 100 | 100 | — | 100 | — | 100 | — | — | — | — |
| | Zinc acrylate | 18.4 | 17 | — | 18.4 | — | 18.4 | — | — | — | — |
| | Dicumyl peroxide | 1.2 | 1.2 | — | 1.2 | — | 1.2 | — | — | — | — |
| | Antioxidant | 0.2 | 0.2 | — | 0.2 | — | 0.2 | — | — | — | — |
| | Zinc oxide | 5 | 5 | — | 5 | — | 5 | — | — | — | — |
| | Barium sulfate | 23.8 | 24.4 | — | 33.7 | — | 25.4 | — | — | — | — |
| | Hytrel 4001 | — | — | 100 | — | — | — | — | — | — | — |
| | Hytrel 3078 | — | — | — | — | 100 | — | — | — | — | — |
| | ZnO (per 100 parts of resin) | — | — | — | — | 20 | — | — | — | — | — |
| Inner cover | Himilan 1605 | 50 | — | 50 | 50 | 50 | — | 50 | 50 | — | — |
| | Himilan 1706 | 50 | — | 50 | 50 | 50 | — | 50 | 50 | 100 | — |
| | Himilan AM7317 | — | 50 | — | — | — | — | — | — | — | — |
| | Himilan AM7318 | — | 50 | — | — | — | — | — | — | — | — |
| | Hytrel 5557 | — | — | — | — | — | 100 | — | — | — | — |
| | Tungsten (per 100 parts of resin) | — | — | — | — | — | — | — | — | 39.5 | — |
| | ZnO (per 100 parts of resin) | — | — | — | 20 | 20 | — | — | — | — | — |
| Outer cover | Pandex T7890 | 100 | — | 100 | — | — | — | — | — | — | — |
| | Pandex T7298 | — | 100 | — | — | — | — | — | — | — | — |

TABLE 1-continued

| | Example | | | | | | Comparative Example | | | |
|---|---|---|---|---|---|---|---|---|---|---|
| | 1 | 2 | 3 | 4 | 5 | 6 | 1 | 2 | 3 | 4 |
| Surlyn 8120 | — | — | — | 50 | 50 | 100 | 100 | 100 | — | 100 |
| Himilan 1706 | — | — | — | 50 | 50 | — | — | — | 50 | — |
| Himilan 1605 | — | — | — | — | — | — | — | — | 50 | — |

Himilan: ionomer resin by Mitsui-dupont Polychemical K.K.
Surlyn: ionomer resin by E. I. duPont
Hytrel: polyester thermoplastic elastomer by Toray-duPont K.K.
Pandex: thermoplastic polyurethane elastomer by Dai-Nihon Ink Chemical Industry K.K.

TABLE 2

| | | Example | | | | | | Comparative Example | | | |
|---|---|---|---|---|---|---|---|---|---|---|---|
| | | 1 | 2 | 3 | 4 | 5 | 6 | 1 | 2 | 3 | 4 |
| Structure | | 4-layer | 4-layer | 4-layer | 4-layer | 4-layer | 4-layer | 3-layer | 3-layer | 3-layer | 2-layer |
| Inner sphere | Diameter (mm) | 23.9 | 28.9 | 33.7 | 23.9 | 33.7 | 23.9 | 35.3 | 35.3 | 36.7 | 38.7 |
| | Specific gravity | 1.158 | 1.158 | 1.162 | 1.130 | 1.168 | 1.167 | 1.260 | 1.260 | 1.133 | 1.191 |
| | Hardness (100 kg)* (mm) | 2.9 | 2.5 | 4.0 | 2.9 | 4.0 | 2.9 | 3.2 | 4.8 | 3.3 | 2.9 |
| | Surface hardness (Shore D) | 53 | 56 | 47 | 53 | 47 | 53 | 50 | 42 | 51 | 54 |
| Enclosure layer | Gage (mm) | 5.8 | 3.3 | 1.5 | 6.1 | 1.5 | 6.1 | — | — | — | — |
| | Specific gravity | 1.158 | 1.158 | 1.100 | 1.214 | 1.246 | 1.167 | — | — | — | — |
| | Surface hardness (Shore D) | 38 | 33 | 40 | 38 | 33 | 38 | — | — | — | — |
| Inner cover | Gage (mm) | 1.8 | 1.8 | 1.5 | 1.8 | 1.5 | 1.8 | 2.2 | 2.2 | 1.5 | — |
| | Specific gravity | 0.950 | 0.950 | 0.950 | 1.101 | 1.101 | 1.170 | 0.950 | 0.950 | 1.300 | — |
| | Hardness (Shore D) | 65 | 68 | 65 | 66 | 66 | 55 | 65 | 65 | 63 | — |
| Outer cover | Gage (mm) | 1.8 | 1.8 | 1.5 | 1.5 | 1.5 | 1.5 | 1.5 | 1.5 | 1.5 | 2.0 |
| | Phantom specific gravity | 1.13 | 1.13 | 1.13 | 0.88 | 0.88 | 0.88 | 0.88 | 0.88 | 0.88 | 0.88 |
| | Hardness (Shore D) | 40 | 48 | 40 | 53 | 53 | 47 | 47 | 47 | 65 | 47 |
| Ball | Diameter (mm) | 42.7 | 42.7 | 42.7 | 42.7 | 42.7 | 42.7 | 42.7 | 42.7 | 42.7 | 42.7 |
| | Weight (g) | 45.3 | 45.3 | 45.3 | 45.3 | 45.3 | 45.3 | 45.3 | 45.3 | 45.3 | 45.3 |
| Moment of Inertia** ($g \cdot cm^2$) | | 83.18 | 83.18 | 83.00 | 81.75 | 81.73 | 81.92 | 79.50 | 79.50 | 82.92 | 81.15 |
| #W1/HS50 | Spin (rpm) | 2660 | 2660 | 2640 | 2630 | 2530 | 2550 | 2780 | 2550 | 2690 | 2770 |
| | Carry (m) | 235.5 | 235.1 | 235.9 | 235.5 | 236.5 | 236.2 | 233.4 | 230.2 | 236.4 | 233.6 |
| | Total (m) | 252.6 | 252.1 | 253 | 252.8 | 253.8 | 253.4 | 249.7 | 247.8 | 253.8 | 249.9 |
| | Feel | ○ | ○ | ○ | ○ | ○ | ○ | X | Δ | X | X |
| #SW/HS25 | Spin (rpm) | 8450 | 8300 | 8430 | 8200 | 8190 | 8310 | 8300 | 8270 | 6640 | 8300 |
| | Run (m) | 0.6 | 1.0 | 0.7 | 1.2 | 1.2 | 1.1 | 1.9 | 2.1 | 3.2 | 1.8 |
| | Feel | ○ | ○ | ○ | ○ | ○ | ○ | Δ | ○ | X | Δ |
| #PT/HS5 | Rolling | ○ | ○ | ○ | ○ | ○ | ○ | X | X | ○ | X |
| | Feel | ○ | ○ | ○ | ○ | ○ | ○ | Δ | ○ | X | Δ |

*a distortion (mm) of a ball under an applied load of 100 kg
**The moment of inertia determined from equation (1) wherein the ball weight is 45.3 grams is 81.65 $g \cdot cm^2$.

Multi-piece solid golf balls within the scope of the invention were found to have advantages including an increased flight distance, improved spin, a soft hitting feel with click, ease of control due to a minimized run, and straight-path rolling on the green without the influence of subtle angulations on the green since the inner sphere, enclosure layer, inner cover, and outer cover and the weight and inertia moment of the golf ball were optimized. In contrast, the golf ball of Comparative Example 1 presented a hard feel upon driver shots, a lack of spin sustainment and poor flight performance due to a smaller inertia moment, and unsatisfactory rolling upon putting. The golf ball of Comparative Example 2 was soft in hitting feel, but lacked click due to the so-called "coreless" softness, and presented poor restitution due to the softness of the core and cover, a lack of spin sustainment and poor flight performance due to a smaller moment of inertia, and unsatisfactory rolling upon putting. Further, the golf ball of Comparative Example 3 presented spin sustainment and an increased flight distance due to the greater specific gravity of the inner cover and the greater inertia moment, but suffered from a hard hitting feel due to the hard core and a lack of control due to the hard cover. Still further, the golf ball of Comparative Example 4 presented a hard hitting feel due to the hard core, an increased spin rate and a shorter flight distance due to the soft cover, and a lack of spin sustainment due to a smaller moment of inertia and were inferior in flight performance, controllability and rolling upon putting.

We claim:

1. A multi-piece solid golf ball comprising; a core including an inner sphere and at least one enclosure layer surrounding the inner sphere and a cover consisting of an inner cover surrounding the core and an outer cover surrounding the inner cover, said inner sphere having a hardness expressed by a distortion of 1.5 to 4.5 mm under a load of 100 kg, said enclosure layer having a surface hardness lower than the surface hardness of the inner sphere in Shore D, said inner cover having a Shore D hardness of at least 55, said outer cover having a Shored D hardness or 35 to 53, said ball has a weight of 44.5 to 45.93 grams and a moment of inertia of at least (1.52×ball weight (gram)+12.79) g·cm$^2$, and at least one layer of the outer cover, the inner cover and the enclosure layer has a high specific gravity inorganic filler blended therein.

2. The multi-piece solid golf ball of claim 1 wherein said inner sphere is formed of a rubber base material and has a diameter of 20 to 37 mm, and said core has a diameter of 32 to 41 mm.

3. The multi-piece solid golf ball of claim 1 wherein the inner cover has a gage of 0.5 to 3 mm, the outer cover has a gage of 0.3 to 3 mm, and the difference in Shore D hardness between the inner cover and the outer cover is at least 5.

4. The multi-piece solid golf ball of any one of claim 1 wherein the outer cover is formed of a thermoplastic polyurethane elastomer.

5. A multi-piece solid golf ball comprising; a core including an inner sphere and at least one enclosure layer surrounding the inner sphere and a cover consisting of an inner cover surrounding the core and an outer cover surrounding the inner cover, said inner sphere having a hardness expressed by a distortion of 1.5 to 4.5 mm under a load of 100 kg, said enclosure layer having a surface hardness lower than the surface hardness of the inner sphere in Shore D, said inner cover having a Shore D hardness of at least 55, said outer cover is formed of a thermoplastic polyurethane elastomer and has a Shore D hardness of 35 to 53, and said ball having a weight of 44.5 to 45.93 grams and a moment of inertia of at least (1.52×ball weight (gram)+12.79) g·cm$^2$.

6. A multi-piece solid golf ball comprising; a core including an inner sphere and at least one enclosure layer surrounding the inner sphere and a cover consisting of an inner cover surrounding the core and an outer cover surrounding the inner cover, said inner sphere having a hardness expressed by a distortion of 1.5 to 4.5 mm under a load of 100 kg, said enclosure layer having a surface hardness lower than the surface hardness of the inner sphere in Shore D, said inner cover having a Shore D hardness of at least 55, said outer cover having a Shore D hardness of 35 to 53, and said ball has a weight of 44.5 to 45.93 grams and a moment of inertia of at least (1.52×ball weight (gram)+12.79) g·cm$^2$, the inner cover having a gage of 0.5 to 3 mm, the outer cover having a gage of 0.3 to 3 mm, and the difference in Shore D hardness between the inner cover and the outer cover being at least 5.

7. The multi-piece solid golf ball of claim 1, wherein the inner cover has a gage in the range of 0.5 to 3 mm and the outer cover has a gage in the range of 1.5 to 3 mm.

8. The multi-piece solid golf ball of claim 5, wherein the inner cover has a gage in the range of 0.5 to 3 mm and the outer cover has a gage in the range of 1.5 to 3 mm.

9. The multi-piece solid golf ball of claim 6, wherein the inner cover has a gage in the range of 0.5 to 3 mm and the outer cover has a gage in the range of 1.5 to 3 mm.

10. The multi-piece solid golf ball of claim 5, wherein said inner sphere is formed of a rubber base material and has a diameter of 20 to 37 mm, and said core has a diameter of 32 to 41 mm.

11. The multi-piece solid golfball of claim 6, wherein said inner sphere is formed of a rubber bas material and has a diameter of 20 to 37 mm, and said core has a diameter of 32 to 41 mm.

12. The multi-piece solid golf ball of claim 5, wherein the inner cover has a gage of 0.5 to 3 mm, the outer cover has a gage of 0.3 to 3 mm, and the difference in Shore D hardness between the inner cover and the outer cover is at least 5.

* * * * *